US009290314B2

(12) United States Patent
D'Alfonso et al.

(10) Patent No.: US 9,290,314 B2
(45) Date of Patent: Mar. 22, 2016

(54) PACKET FOR TOBACCO PRODUCTS

(71) Applicant: G.D S.p.A., Bologna (IT)

(72) Inventors: Lorena D'Alfonso, Lettomanoppello (IT); Marco Ghini, Monte San Pietro (IT); Luca Petrucci, Castelfranco Emilia (IT); Roberto Polloni, Modigliana (IT); Stefano Negrini, Calderara di Reno (IT)

(73) Assignee: G.D S.p.A. (IT)

( * ) Notice: Subject to any disclaimer, the term of this patent is extended or adjusted under 35 U.S.C. 154(b) by 0 days.

(21) Appl. No.: 14/407,407

(22) PCT Filed: Jun. 26, 2013

(86) PCT No.: PCT/IB2013/055248
§ 371 (c)(1),
(2) Date: Dec. 11, 2014

(87) PCT Pub. No.: WO2014/002029
PCT Pub. Date: Jan. 3, 2014

(65) Prior Publication Data

US 2015/0144512 A1 May 28, 2015

(30) Foreign Application Priority Data

Jun. 27, 2012 (IT) ..... BO2012A0355

(51) Int. Cl.
*B65D 85/10* (2006.01)
*B65D 5/42* (2006.01)
*B65D 5/66* (2006.01)

(52) U.S. Cl.
CPC ..... *B65D 85/1063* (2013.01); *B65D 5/422* (2013.01); *B65D 5/4237* (2013.01); *B65D 5/6602* (2013.01); *B65D 85/1045* (2013.01)

(58) Field of Classification Search
CPC .... B65D 5/422; B65D 5/4237; B65D 5/6602; B65D 85/10; B65D 85/1045; B65D 85/1063; B65D 85/1072; A24F 15/12
USPC ..... 206/256, 258, 271, 526; 229/87.01, 229/87.18
See application file for complete search history.

(56) References Cited

U.S. PATENT DOCUMENTS 5,344,008 A * 9/1994 DeBlasio ..... B65D 85/1072 206/256
D492,814 S * 7/2004 Bray ..... D27/189
(Continued)

FOREIGN PATENT DOCUMENTS

CH EP 1792848 A1 * 6/2007 ..... B65D 85/1045
EP 1616795 A1 1/2006
(Continued)

OTHER PUBLICATIONS

International Search Report and Written Opinion dated Feb. 7, 2014 from counterpart PCT App No. PCT/IB2013/055248.

*Primary Examiner* — Bryon Gehman
(74) *Attorney, Agent, or Firm* — Timothy J. Klima; Shuttleworth & Ingersoll, PLC

(57) ABSTRACT

Described is a packet for tobacco products comprising two containers of tobacco products each substantially having the shape of a parallelepiped and provided with two larger side walls, two smaller side walls, a bottom wall and a top wall, the packet has an outer wrapper having at least one connection panel and at least two additional panels, in particular the containers are connected to the outer wrapper at the at least one connection panel; the packet is provided with a lid, hinged along a first hinge to one of the additional panels, which is able to rotate between a closed position and an open position of the packet and, in the closed position, keeping each of the two additional panels in contact with a respective larger side wall of each container.

10 Claims, 8 Drawing Sheets

(56) References Cited

U.S. PATENT DOCUMENTS

| | | | | |
|---|---|---|---|---|
| 6,941,728 | B1 * | 9/2005 | Bray | B65B 19/20 53/234 |
| 7,347,033 | B2 * | 3/2008 | Gamberini | B65B 19/16 53/234 |
| 8,118,160 | B2 * | 2/2012 | Ghini | B65D 85/1063 206/264 |
| 8,434,497 | B2 * | 5/2013 | Yanchev | B65D 85/1045 131/329 |

FOREIGN PATENT DOCUMENTS

| | | | | |
|---|---|---|---|---|
| FR | WO 8808602 | A1 * | 11/1988 | B65D 5/48002 |
| GB | 2439066 | A * | 12/2007 | B65D 85/10 |
| IT | EP 1616795 | A1 * | 1/2006 | B65B 19/20 |
| IT | WO 2006067621 | A1 * | 6/2006 | B65D 85/1063 |
| WO | WO8808602 | A1 | 11/1988 | |
| WO | WO2006067621 | A1 | 6/2006 | |

* cited by examiner

PACKET FOR TOBACCO PRODUCTS

This application is the National Phase of international Application PCT/IB2013/055245 filed Jun. 26, 2013 which designated the U.S.

This application claims priority to Italian Patent Application No. BO2012A000355 filed Jun. 27, 2012, which application is incorporated by reference herein.

TECHNICAL FIELD

This invention relates to a packet for tobacco products.

This invention is particularly advantageous in a packet of cigarettes of the hard type, to which this description will hereinafter refer but without thereby limiting the scope of the invention.

BACKGROUND ART

Hard, hinged-lid packets are currently the most widespread type on the market because they are simple to make, easy and practical to use and provide good mechanical protection for the cigarettes they contain.

A hard, hinged-lid packet of cigarettes normally comprises a lower container having an open end, and a lid, which is hinged to the lower container allowing it to rotate, relative to the container, between an open position and a closed position of the open end. The lid, when it is in the closed position, gives the packet a parallelepiped shape defined by a side surface and by two bottom walls.

Typically, the outer surface of a packet is printed to bear the brand, a description of the cigarettes contained in the packet, the mandatory information linked to health risks, and any publicity messages. In some situations the manufacturers of cigarette packets need to provide their customers with a significant quantity of information, which it is difficult to print sufficiently clearly on the outer surface of the packet, since that surface is relatively small and is largely occupied by the mandatory information linked to health risks. For this reason it is normal practice to provide a leaflet with a packet of cigarettes, which is inserted inside the packet or fixed to the outside of the packet by one or more spots of glue.

A packet of cigarettes with a leaflet of the type described above is costly to make as the packing machine must be provided with a station for feeding material for the leaflets and for controlling the leaflets for associating them with the packets; moreover, the leaflet separated from the packet is more complex to consult and constitutes an annoying hindrance for the user if it is not eliminated during the first opening of the packet.

DISCLOSURE OF THE INVENTION

The aim of the present invention is to produce a packet for tobacco products which has a greater usability compared with known packets and is free of the above mentioned drawbacks.

The invention accordingly provides a packet for tobacco products as described in the appended claims.

BRIEF DESCRIPTION OF DRAWINGS

The invention is described below with reference to the accompanying drawings, which illustrate non-limiting embodiments of it, and in which.

DETAILED DESCRIPTION OF PREFERRED EMBODIMENTS OF THE INVENTION

Figure 2:
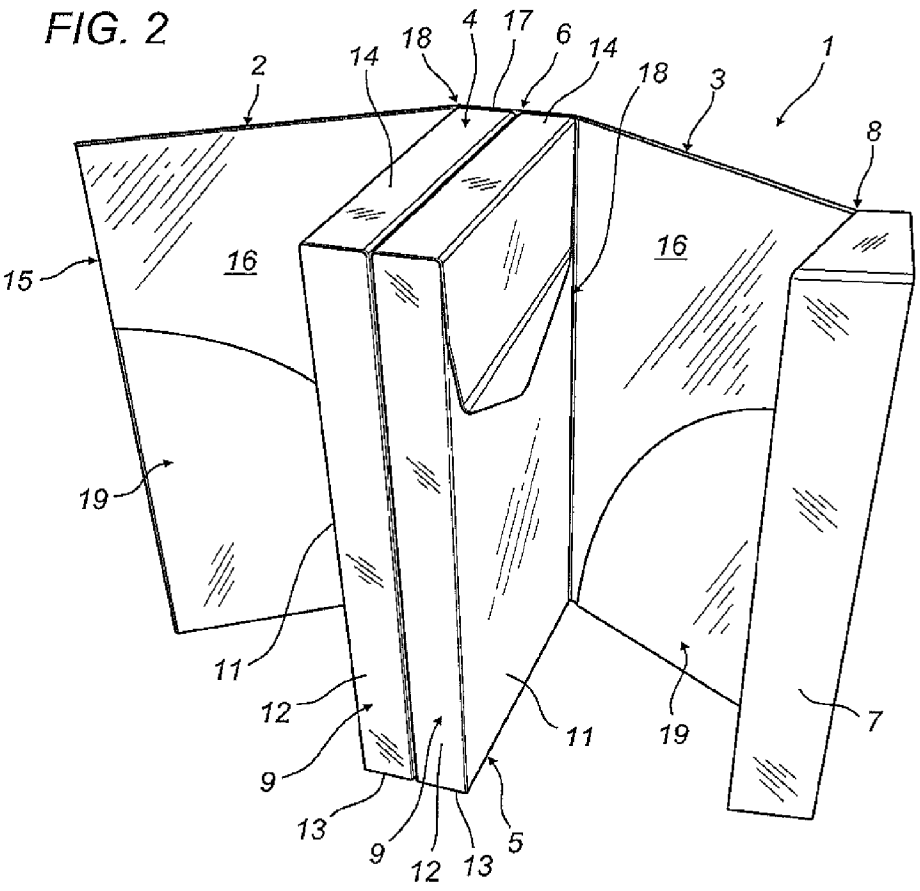
FIG. 2 is a front perspective view of the hard cigarette packet of FIG. 1, in an open configuration.
Figure 1:
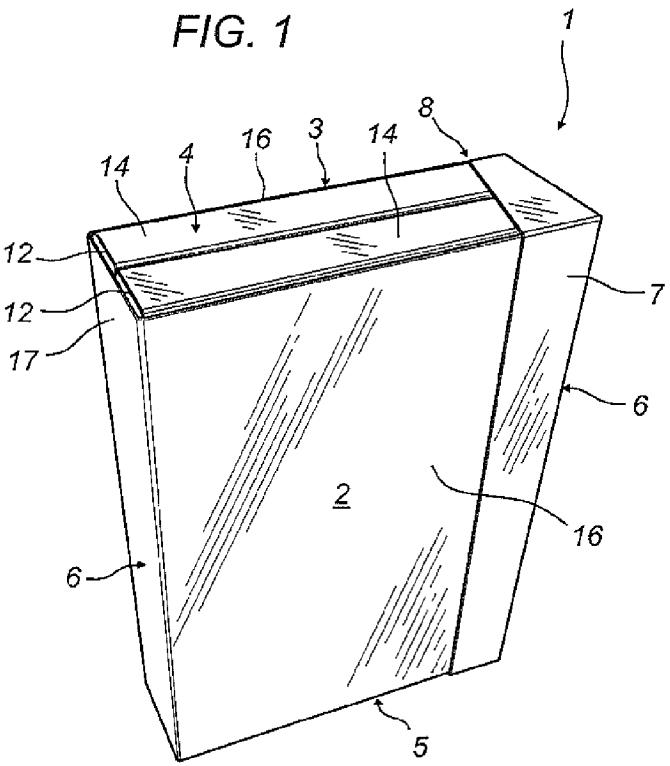
FIG. 1 is a front perspective view of a first embodiment of a hard cigarette packet made in accordance with this invention, in a closed configuration.

With reference to FIGS. 1 and 2, the numeral 1 denotes in its entirety a hard packet of cigarettes substantially having the shape of a parallelepiped comprising a front wall 2 and a larger rear wall 3, a top wall 4, a bottom wall 5, and two sides 6.

The packet 1 comprises a lid 7, hinged along a first hinge 8, which is able to rotate between a closed position (shown in FIG. 1) and an open position (shown in FIG. 2) and vice versa.

The lid 7 is substantially box-shaped and, in the closed position of the packet 1, it partly covers the top wall 4, the bottom wall 5 and the front wall 2, defining a side 6 of the packet.

The above-mentioned first hinge 8 is positioned at the rear wall 3 of the packet 1. More specifically, with reference to the main longitudinal extension of the packet 1, the first hinge 8 is positioned close to a longitudinal edge of the rear wall 3.

Alternatively, the first hinge 8 can be positioned close to a transversal edge of the rear wall 3. In this case, the lid 7, in the closed position of the packet 1, partly covers the sides 6 and the front wall 2, defining the top wall 4 of the packet 1.

In an alternative embodiment, the first hinge 8 is positioned close to a transversal edge of a side 6 of the packet 1. In this case, the cover 7, in the closed position of the packet 1, partly covers the front wall 2, the rear wall 3 and the side 6 opposite the side 6 wherein there is the first hinge 8, and defines the top wall 4 of the packet 1.

The packet 1 comprises at least two containers 9 of cigarettes each comprising an ordered group of cigarettes.

Each container 9 substantially has the shape of a parallelepiped and has two larger side walls 11, two smaller side walls 12, a bottom wall 13 and a top wall 14.

Preferably, each container 9 has a relative closing and opening lid, in such a way as to preserve the ordered groups of cigarettes, thus maintaining the integrity and the aroma.

According to this embodiment of the packet 1, the two containers 9 are in mutual contact at a respective larger side wall 11. More specifically, the containers 9 are mutually connected with each other.

Alternatively, the two containers 9 could be replaced by a single container comprising an ordered group of cigarettes comprising a number of cigarettes equal to the sum of the groups of cigarettes contained in both the containers 9.

The top walls 14 of the containers 9 define the top wall 4 of the packet 1 and the bottom walls 13 define the bottom wall 5 of the packet 1.

The packet 1 comprises an outer wrapper 15 designed to wrap the two containers 9.

The outer wrapper 15 comprises two additional panels 16.

In more general terms, in different embodiments of the packet 1, the outer wrapper 15 of the packet 1 comprises at least two additional panels 16.

The lid 7 is hinged to one of the two additional panels 16 along the first hinge 8.

Advantageously, so as to insert information leaflets inside the packet 1, the additional panels 16 comprise respective pockets 19 (which could be missing) designed to contain them.

Preferably, the pockets 19 are positioned on the inner walls of the additional panels 16, in such a way as to not be visible to the consumer when the packet 1 is in the closed condition.

Alternatively, the additional panels do not have the pockets 19 and the information leaflets can be fixed to the additional panels 16, by using, for example, spots of glue.

The outer wrapper 15 also comprises a connection panel 17, interposed between the two additional panels 16. In more general terms, in different embodiments of the packet 1, the outer wrapper 15 of the packet 1 can comprise more than one connection panel 17.

In the closed condition of the packet 1, the connection panel 17 defines a side 6 of the packet 1.

The connection panel 17 is hinged to a respective additional panel 16 by second hinges 18.

The additional panels 16 are both hinged to the connection panel 17, on opposite sides of the connection panel 17, along respective second hinges 18. More specifically, the second hinges 18 are positioned respectively along respective longitudinal edges of the packet 1.

One of the two additional panels 16 is hinged solely to the connection panel 17 by the second hinge 18, whilst the other additional panel 16 is hinged both to the lid 7 and the connection panel 17, by the first hinge 8 and the second hinge 18.

In other words, the lid 7 and the connection panel 17 are hinged to a same additional panel 16.

More specifically, the first and the second hinge 8 and 18 are positioned on opposite sides relative to the same additional panel 16.

The first and the second hinges 8 and 18 are parallel to each other along the longitudinal direction of extension of the packet 1.

In an embodiment not illustrated, the additional panels 16 are hinged directly to the containers 9 along the respective second hinge 18. The connection panel 17 is therefore replaced by a flap, present symmetrically on both the panels 16, which is fixed to the corresponding larger side wall 11 of the container 9. The second hinge 18 is therefore positioned along a longitudinal edge of the larger side wall 11 of the container 9, on the opposite side relative to the lid 7 of the container 1. The pair of smaller side walls 12 of the respective containers 9 in contact with the second hinges 18 define the side 6 of the packet 1 opposite the hinge 7. This embodiment is advantageous if a single container 9 is present, as already mentioned, or if the two containers 9 are joined by fixing means positioned between the two respective larger side walls 11 facing each other.

The two containers 9 are connected to the outer wrapper 15 at the connection panel 17, and, more specifically, are connected to the connection panel 17 at a respective smaller side wall 12 and are in mutual contact at a relative larger side wall 11.

The smaller side walls 12, opposite the smaller side walls 12 connected to the connection panel 17, are designed to be enclosed by the lid 7 when the packet 1 is in the closed condition.

With reference in particular to FIG. 1, when the packet 1 is in the closed condition the additional panels 16 are in contact with a larger side wall 11 of the respective container 9, defining both the rear wall 3 and the front wall 2 of the packet 1.

More specifically, the two additional panels 16 are kept in contact with the respective larger side wall 11 of each container 9 by the action of the lid 7, hinged to one of the two additional panels 16. For this purpose, the additional panels 16 substantially have the same dimensions as the larger side wall 11 of the containers 9.

When the packet 1 is in the open condition, the additional panels 16 are positioned in a position substantially detached from the containers 9, which are placed in a central position relative to the end position of the additional panels 16. More specifically, the additional panels 16 deviate from the containers 9 by the rotation about the respective second hinges 18.

This open configuration of the packet 1 not only facilitates the consumer in picking out the cigarettes from the containers 9, but allows access to the information leaflets housed in the pocket 19 of each additional panel 16.

Figure 7:
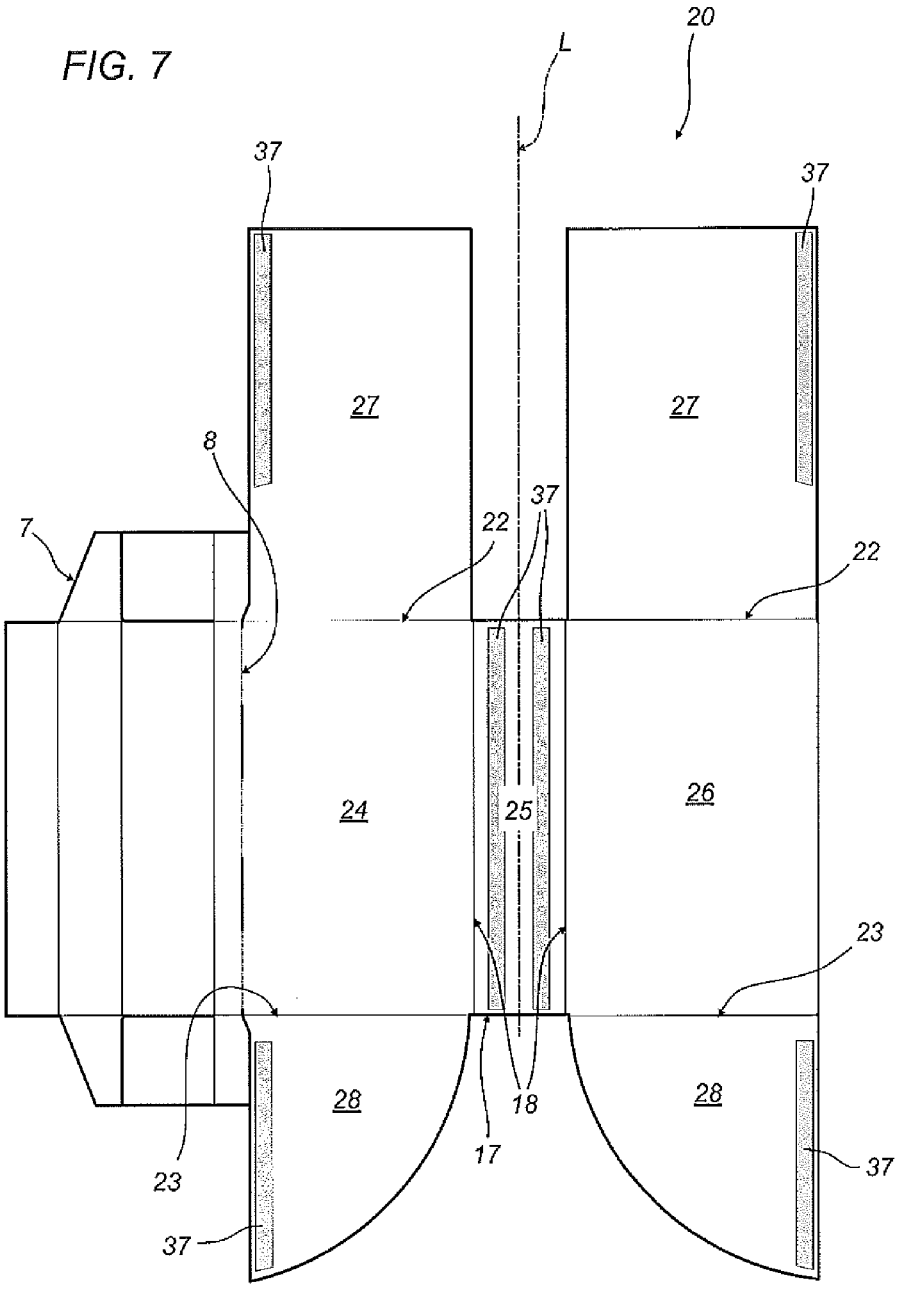
FIGS. 7 and 8 are plan views showing two blanks used to make the hard cigarette packet of FIGS. 1 and 2.
Figure 8:
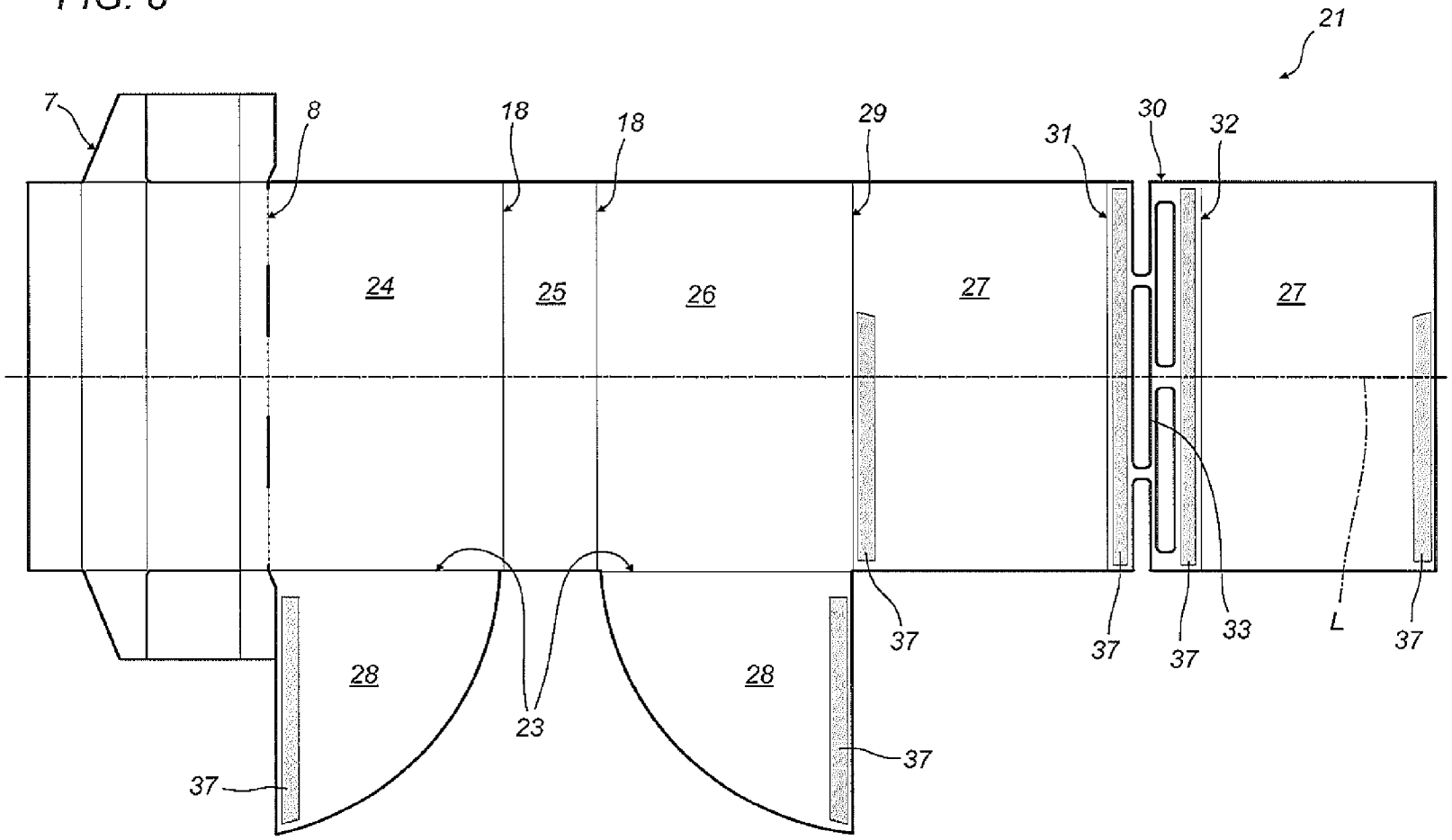

As illustrated in FIGS. 7 and 8, the outer wrapper 15 of the packet 1 is obtained from a pair of flat blanks 20 and 21 having a substantially rectangular shape, elongate according to a relative main axis of extension L.

The blanks 20 and 21 are two alternative embodiments from which it is possible to obtain the outer wrapper 15 of the packet 1.

After obtaining the outer wrapper 15, by folding the blanks 20 and 21, the containers 9, the blanks of which are not described as of known type, are fixed to the outer wrapper 15 by fixing means 37. More specifically, strips of adhesive material 37 define the fixing means.

With reference to FIG. 7, the blank 20 comprises a plurality of longitudinal lines of weakness 8 and 18 and a plurality of transversal lines of weakness 22 and 23, which define a first, a second and a third panel 24, 25 and 26.

The longitudinal lines of weakness 8 and 18 and the transversal lines of weakness 22 and 23 lines of weakness are thereby defined with reference to the main axis of extension L.

More specifically, the longitudinal lines of weakness 8 and 18 are designed to define, respectively, the first hinge 8 and the second hinges 18.

More specifically, from the longitudinal line of weakness 8 extend, in a substantially transversal direction relative to the axis L, a plurality of panels and respective flaps of known type, which, once folded, are designed to define the lid 7 of the packet 1.

The first and the third panels 24 and 26 have, respectively, a transversal line of weakness 22 from which extends, along a direction parallel to the axis L, a relative cover panel 27.

The first and the third panels 24 and 26 have, respectively, a transversal line of weakness 23 from which extends, along a direction parallel to the axis L and from the opposite side relative to the cover panel 27, a respective flap 28.

The cover panels 27 and the flaps 28 have, on their surface, strips of adhesive material 37.

The cover panels 27 are designed to be folded along their relative transversal lines of weakness 22 on the respective panels 24 and 26 and fixed to the latter by the strips of adhesive material 37.

Once the cover panels 27 are folded and fixed on the respective panels 24 and 26, the flaps 28 are then folded along the respective transversal lines of weakness 23.

The flaps 28 are fixed to the respective cover panel 27 by the strips of adhesive material 37 thus defining the pockets 19 of the packet 1.

The first and the third panels 24 and 26 associated with the respective cover panel 27 and the respective flap 28 define the additional panels 16. The second panel 25 is designed to define the connection panel 17.

It should be noted that the second panel 25 comprises the strips of adhesive material 37 which allow the containers 9 to be fixed once the blank 20 has been folded.

The blank 21, shown in FIG. 8, has, at least partly, the same characteristics as the blank 20 which is indicated below with the same reference numeral. More specifically, the blank 21 differs from the blank 20 since the cover panels 27 extend from the third panel 26.

A cover panel 27 is connected directly to the third panel 26 by a fourth line of weakness 29.

A connecting panel 30 is connected to the cover panel 27 by a fifth line of weakness 31.

A further cover panel 27 is connected to the connecting panel 30 by a sixth line of weakness 32.

The cover panels 27 and the connecting panel 30 extend in line with the first, second and third panels 24, 25 and 26 along the direction of extension of the axis L.

In this alternative embodiment, the lines of weakness 8 and 18 are substantially transversal to the axis L, whilst the lines 23 are substantially parallel to the axis L.

More specifically, the fourth, the fifth and the sixth lines of weakness 29, 31 and 32 and the lines of weakness 8 and 18 are parallel to each other, in a direction transversal to the direction of the axis of extension L.

The cover panels 27 and the connecting panel 30 have on their surface strips of adhesive material 37.

The additional panels 16 of the outer wrapper 15 are obtained by folding the cover panel 27 along the fourth longitudinal line of weakness 29, in such a way as to superpose on the first panel 24 and the third panel 26 a respective cover panel 27 and the connection panel 17 of the outer wrapper 15 is obtained by superposing on the second panel 25 the connecting panel 30.

The cover panels 27 and the connecting panel 30 are fixed to the respective panels 24, 26 and 25 by the strips of adhesive material 37.

At this point, the flaps 28 are folded along the respective lines of weakness 23 on the relative cover panel 27 and fixed to the latter by the strips of adhesive material 37, thus defining the pocket 19.

The first and the third panels 24 and 26 associated with the respective cover panel 27 and the respective flap 28 define the additional panels 16.

The second panel 25 associated with the connecting panel 30 defines the connection panel 17.

The connecting panel 30 comprises means 33 for compensating the stresses of the wrapping material designed to deform, during the opening and closing of the packet 1, preventing the formation of bubbles or creases in the wrapping material of the outer wrapper 15.

More specifically, the compensation means 33 comprise strips of wrapping material shaped substantially as a mesh and defined by slots made in the connecting panel 30.

Figure 3:
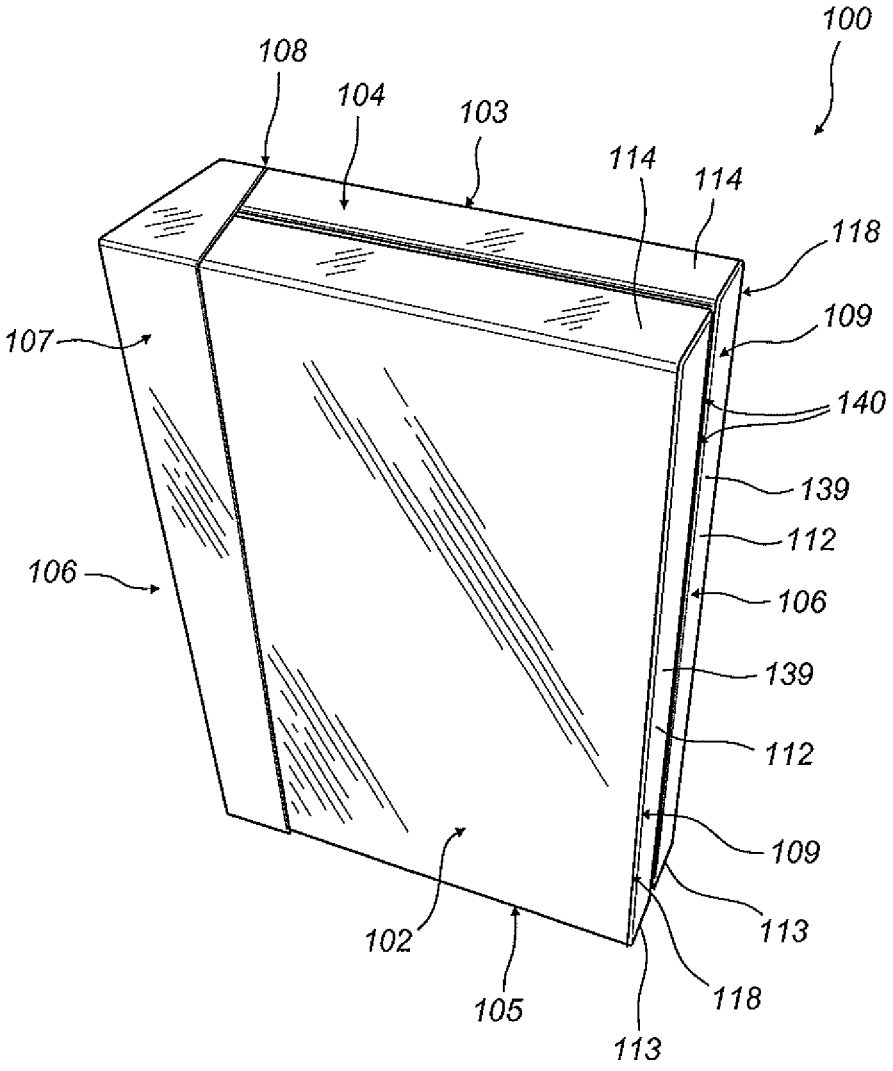
FIG. 3 is a front perspective view of a second embodiment of a hard cigarette packet made in accordance with this invention, in a closed configuration.
Figure 4:
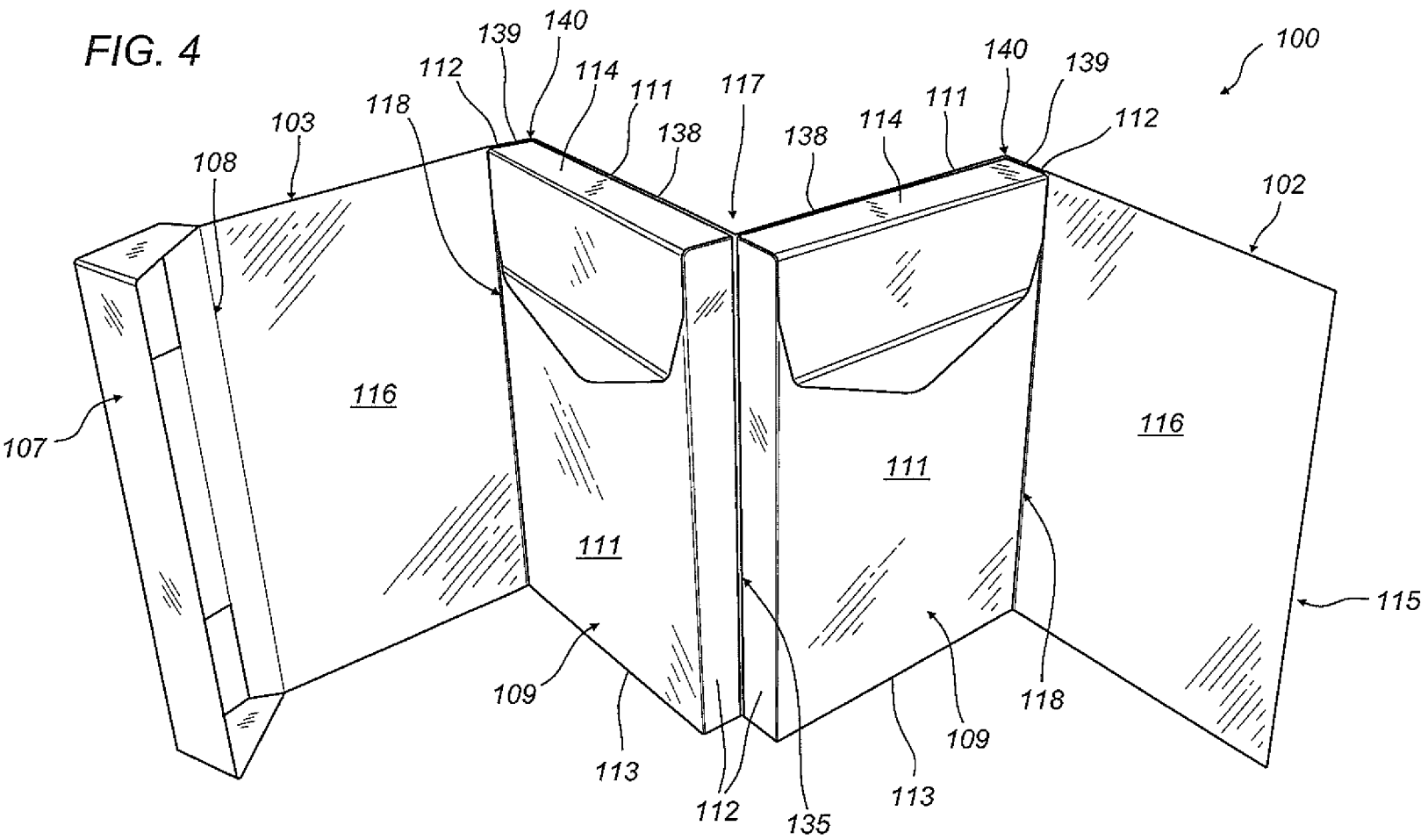
FIG. 4 is a front perspective view of the hard cigarette packet of FIG. 3, in an open configuration.

FIGS. 3 and 4 illustrate a second embodiment of a packet 100 of cigarettes, comprising a front wall 102 and a larger rear wall 103, a top wall 104, a bottom wall 105, and two sides 106.

The packet 100 comprises a lid 107, hinged along a first hinge 108, which is able to rotate, relative to the packet 100, between a closed position (shown in FIG. 3) and an open position (shown in FIG. 4) and vice versa.

The lid 107 is box-shaped and, in the closed position of the packet 100, it partly covers the top wall 104, the bottom wall 105 and the front wall 102, defining a side 106 of the packet.

The first hinge 108, along which the lid 107 of the packet 100 is hinged, is positioned at the rear wall 103 of the packet 100. More specifically, the first hinge 108 is positioned close to a longitudinal edge of the rear wall 103, with reference to the main longitudinal extension of the packet 100.

The packet 100 comprises at least two containers 109 of cigarettes each comprising an ordered group of cigarettes.

Each container 109 substantially has the shape of a parallelepiped and has two larger side walls 111, two smaller side walls 112, a bottom wall 113 and a top wall 114.

Preferably, each container 109 has a relative closing and opening lid, in such a way as to preserve the ordered groups of cigarettes, thus maintaining the integrity and the aroma.

The packet 100 comprises an outer wrapper 115 designed to wrap the two containers 109.

The outer wrapper 115 comprises two additional panels 116. In more general terms, in different embodiments of the packet 100, the outer wrapper 115 of the packet 100 comprises at least two additional panels 116.

The lid 107 is hinged to one of the two additional panels 116 along the first hinge 108.

The outer wrapper 115 also comprises a connection panel 117, interposed between the two additional panels 116. In more general terms, in different embodiments of the packet 100, the outer wrapper 115 of the packet 100 can comprise more than one connection panel 117.

The two containers 109 are connected to the connection panel 117.

The connection panel 117 is subdivided by a line of weakness (third hinge line 135) into a pair of first connection panels 138 and second connection panels 139.

More specifically, the first connection panels 138 are hinged together along the third line of weakness 135, which is positioned along a longitudinal edge of the first connection panels 138, with reference to the main longitudinal extension of the packet 100.

Each second connection panel 139 is contiguous with a first connection panel 138, and together with the panel 138 defines an edge 140.

A larger side wall 111 of each container 109 is connected with a respective first connection panel 138.

A smaller side wall 112 of each container 109 is connected with a respective first connection panel 139.

The two containers 109 are connected to the outer wrapper 115 at the connection panel 117, and, in particular, as each container 109 is connected to a first and second connection panel 138 and 139 by a relative larger side wall 111 and a relative smaller side wall 112, the contiguous edge 140 replicates a longitudinal edge of each container 109, the longitudinal edge of which is positioned between the larger side wall 111 and the smaller side wall 112.

The connection panel 117 is hinged to a respective additional panel 116 by second hinges 118.

The additional panels 116 are both hinged to the connection panel 117, on opposite sides of the connection panel 117, along respective second hinges 118.

More specifically, the second hinges 118 connect the additional panels 116 with the respective second connection panels 139.

The second hinges 118 of each additional panel 116 are positioned, respectively, along the longitudinal edges of the packet 100, with reference to the longitudinal extension of the packet 100.

One of the two additional panels 116 is hinged solely to the connection panel 117 by the second hinge 118, whilst the other additional panel 116 is hinged both to the lid 107 and the connection panel 117, by the first hinge 108 and the second hinge 118.

In other words, the lid 107 and a connection panel 139 are hinged to a same additional panel 116.

More specifically, the first and the second hinges 108 and 118 are positioned on opposite sides relative to the same additional panel 116.

The first hinge 108, the second hinges 118 and the third hinge 135 are parallel to each other along a direction parallel to the longitudinal direction of extension of the packet 100.

When the packet 100 is in the closed condition, the additional panels 116 are in contact with the respective larger side wall 111 of each container 109. In this way, the additional panel 116 to which the lid 107 is hinged defines the rear wall 103 of the packet 100, whilst the additional panel 116 hinged only to the connection panel 117 defines the front wall 102 of the packet 100.

More specifically, the two additional panels 116 are kept in contact with the respective larger side wall 111 of each container 109 by the lid 107, hinged to one of the two additional panels 116. For this purpose, the additional panels 116 substantially have the same dimensions as the larger side wall 111 of the container 109.

The side 106 of the closed packet 100, opposite the lid 107, is defined by the connection panel 117, in particular by the second connection panels 139.

In other words, in the closed condition of the packet 100, the second connection panels 139 define a side 106 of the packet 100.

The top wall 104 is defined by the top walls 114 of the containers 109 and the bottom wall 105 is defined by the bottom walls 113 of the containers 109.

Preferably, the first connection panels 138 have, on their outer wall, fixing means 137 which keep the panels 138 joined and in mutual contact in the closed condition of the packet 100.

It should be noted that the presence of the fixing means 137, which connect the first connection panels 138 together in the closed condition of the packet 100, safeguard the consumer from the integrity of the packet 100 during the first opening.

Figure 9:
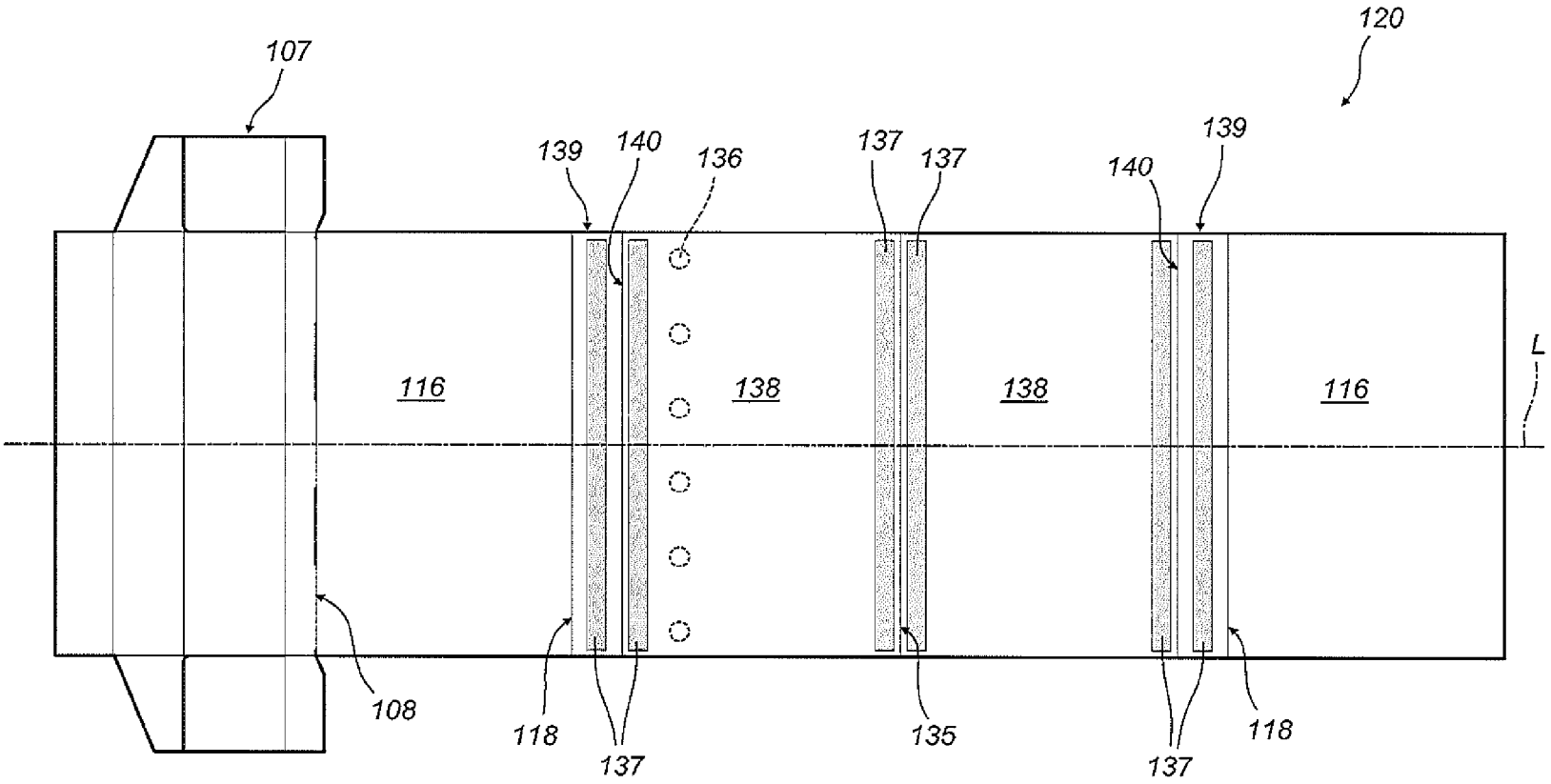
FIG. 9 is a plan view showing a blank used to make the hard cigarette packet of FIGS. 3 and 4.

The fixing means 137 are of the adhesive type, and could also comprise glue of the repositionable type, which are shown in FIG. 9 by a dashed line and marked with the numeral 136.

When the packet 100 is in the open condition, the additional panels 116 are positioned in a position substantially detached from the containers 109.

More specifically, the open packet 100 has a "W" shape wherein the additional panels 116 are positioned in an end position relative to the containers 109, positioned in a central position.

The additional panels 116 detach from the containers 109 by the rotation about the second hinges 118 and the containers 109 detach, respectively, from each other by the rotation about the third hinge 135.

This open configuration of the packet 100 not only facilitates the consumer in picking out the cigarettes from the containers 109, but allows access to the information leaflets present on each additional panel 116 with methods similar to those described with reference to FIGS. 1 and 2.

The outer wrapper 115 of the packet 100 is obtained from a flat blank 120 having a substantially rectangular shape according to a main axis of extension L, as shown in FIG. 9.

After obtaining the outer wrapper 115, by folding the blank 120, the containers 109, the blanks of which are not described as of known type, are fixed to the outer wrapper 115 by fixing means 137. More specifically, strips of adhesive material 137 define the fixing means.

The blank 120 has a plurality of lines of weakness 108, 118, 140 and 135 which define the additional panels 116, the first and second connection panels 138 and 139.

The additional panels 116, the first and the second connection panels 138 and 139 are connected to each other by the respective lines of weakness 108, 118, 140 and 135 and extend in line along a direction parallel to the axis L.

The lines of weakness 108, 118, 140 and 135 are parallel to each other along a direction transversal to the main axis of extension L of the blank 120.

The lines of weakness 108, 118 and 135 are designed to define, respectively, the first hinge 108, the second hinges 118 and the third hinge 135.

More specifically, from the line of weakness 108 extend, from the opposite side to the additional panel 116, a plurality of panels and respective flaps of known type, which, once folded, are designed to define the lid 107 of the packet 100.

The lines of weakness 140 are designed to define the contiguous edge of the first and second connection panels 138 and 139.

Preferably, the first and second connection panels 138 and 139 each comprise strips of adhesive material 137 which allow the containers 109 to be fixed to the blank 120 of the outer wrapper 115.

In an alternative embodiment of the blank 120, not shown, cover panels and flaps (not illustrated) can be associated with the additional panels 116, made in a fashion similar to that shown in FIG. 2, which once folded define pockets designed to house leaflets.

Figure 6:
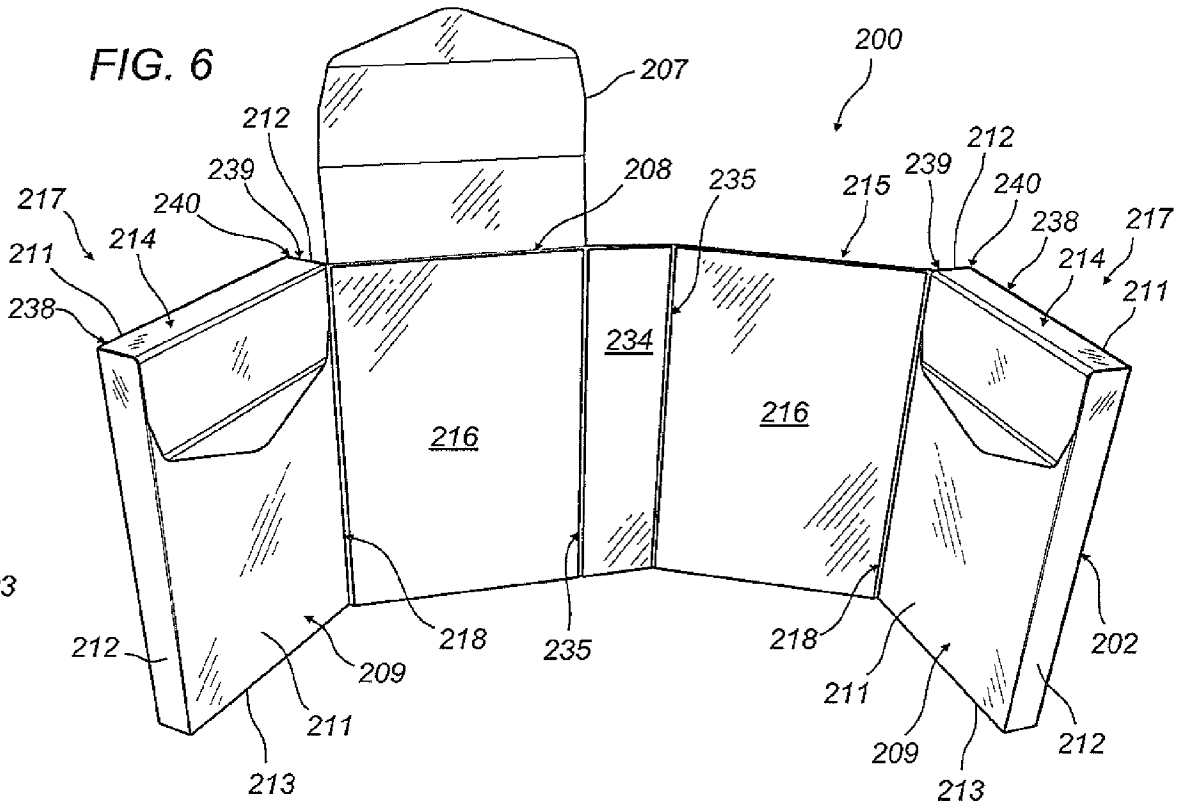
FIG. 6 is a front perspective view of the hard cigarette packet of FIG. 5, in an open configuration.
Figure 5:
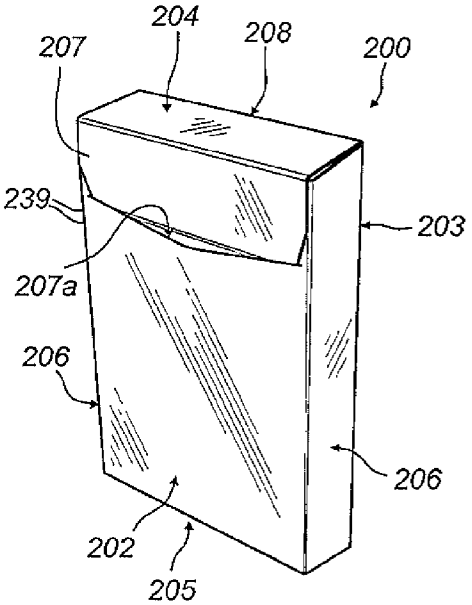
FIG. 5 is a front perspective view of a third embodiment of a hard cigarette packet made in accordance with this invention, in a closed configuration.

FIGS. 5 and 6 illustrate a third embodiment of a hard packet 200 of cigarettes, comprising a front wall 202 and a larger rear wall 203, a top wall 204, a bottom wall 205, and two sides 206.

The packet 200 comprises a lid 207, hinged along a first hinge 208, which is able to rotate, relative to the packet 200, between a closed position (shown in FIG. 5) and an open position (shown in FIG. 6) and vice versa.

The lid 207 is made in the form of a tab which, in the closed condition of the packet 200, partly covers the front wall 202, defining the top wall 204 of the packet 200. More specifically, the lid 207 engages in a notch 210 made on the front wall 202.

Preferably, the notch 210 is substantially U-shaped.

The first hinge 208, along which the lid 207 of the packet 200 is hinged, is positioned at the rear wall 203 of the packet 200. More specifically, the first hinge 208 is positioned along a transversal edge of the rear wall 203, with reference to the main longitudinal extension of the packet 200.

The hard packet 200 of cigarettes comprises two containers 209, each comprising an ordered group of cigarettes.

The containers 209 are substantially parallelepiped in shape and have two larger side walls 211, two smaller side walls 212, a bottom wall 213 and a top wall 214.

The top walls 214 of the containers 209 and the lid 207 define the top wall 204 of the packet 200 and the bottom walls 213 define the bottom wall 205 of the packet 200.

Preferably, each container 209 has a relative closing and opening lid, in such a way as to preserve the ordered groups of cigarettes, thus maintaining the integrity and the aroma.

The packet 200 comprises an outer wrapper 215 designed to wrap the two containers 209.

The outer wrapper 215 comprises two additional panels 216. In more general terms, in different embodiments of the packet 200, the outer wrapper 215 of the packet 200 comprises at least two additional panels 216.

The outer wrapper 215 also comprises an intermediate panel 234 interposed between the two additional panels 216.

The intermediate panel 234 is hinged to the additional panels 216 by third hinges 235.

In other words, the additional panels 216 are both hinged to the intermediate panel 234, on opposite sides of the intermediate panel 234, along the respective third hinges 235.

The outer wrapper 115 also comprises two connection panels 217.

The connection panels 217 are hinged to a respective additional panel 216 by second hinges 218.

The two containers 209 are connected to a respective connection panel 217.

Each connection panel 217 is subdivided into first and second connection panels 238 and 239.

Each second connection panel 239 is contiguous with a first connection panel 238, defining with it an edge 240.

The two containers 209 are connected to the outer wrapper 215 at the connection panel 217, and in particular a larger side wall 211 of each container 209 is connected to a respective first connection panel 238 and a smaller side wall 212 of each container 209 is connected to a respective second connection panel 239.

As each container 209 is connected to a first and a second connection panel 238 and 239 by a relative larger side wall 211 and a relative smaller side wall 212, the contiguous edge 240 replicates the longitudinal edge defined by the larger side wall 211 and by the smaller side wall 212 of each container 209.

Each second connection panel 239 is hinged to a respective additional panel 216 by second hinges 218.

The second connection panels 239 are hinged to a respective additional panel 216 from the opposite side relative to the intermediate panel 234.

More specifically, each additional panel 216 has the second hinge 218 and the third hinge 235.

The second hinges 218 and the third hinges 235 of each additional panel 216 are positioned, respectively, along longitudinal edges of the packet 200, with reference to the main longitudinal extension of the packet 200.

More specifically, the third hinges 235 connect the additional panels 116 with the intermediate panel 234 and the second hinges 218 connect the second connection panels 239 to the respective additional panels 216.

The lid 207 is hinged to one of the two additional panels 216 along the first hinge 208.

One of the two additional panels 216 is therefore hinged to the connection panel 239 by the second hinge 218 and to the intermediate panel 234 by the third hinge 235, whilst the other additional panel 216 is hinged to the lid 207, to the connection panel 239 and to the intermediate panel 234, respectively, by the first hinge 208, the second hinge 218 and the third hinge 235.

The second hinges 218 and the third hinges 235 are parallel to each other along a direction parallel to the longitudinal direction of extension of the packet 200, whilst the first hinge 208, as already mentioned, is positioned along a direction transversal to the longitudinal direction of extension of the packet 200.

In the closed condition of the packet 200, the additional panels 216 are in contact with the larger side wall 211 of the respective container 209. In this way, the additional panel 216 to which the lid 207 is hinged defines the rear wall 203 of the packet 200, whilst the other additional panel 216 defines the front wall 202 of the packet 200, in which the notch 210 is present.

The lid 207 and a connection panel 239 are hinged to a same additional panel 216.

In other words, in the closed condition of the packet 200 the second connection panels 239 define a side 206 of the packet 200 and the intermediate panel 234 defines the other side 206 of the packet 200.

More specifically, the two additional panels 216 are kept in contact with the respective larger side wall 211 of each container 209 by the lid 207, hinged to one of the two additional panels 216 and engaged in the notch 210 made in the other additional panel 216. For this purpose, the additional panels 216 substantially have the same dimensions as the larger side wall 211 of the container 209.

When the packet 200 is in the open condition, the additional panels 216 are positioned in a position substantially detached from the containers 209.

More specifically, the open packet 200 has a so-called "separé" shape ("partitioned packet" or "divided packet") wherein the containers 209 are positioned in an end position relative to the additional panels 216, positioned in a central position relative to the connection panels 217. In other words, the additional panels 216 are interposed between the two containers 209.

The rotation about the third hinges 235 allows the consumer to obtain a partial opening of the packet 200, the so-called "open book", at which the containers 209 are placed in a substantially aligned position, with the respective larger side walls 211 still in contact with the additional panel 216.

The subsequent rotation about the second hinges 218 allows the consumer to obtain the full opening of the packet 200.

This open configuration of the packet 200 not only facilitates the consumer in picking out the cigarettes from the containers 209, but allows access to the information leaflets present on each additional panel 216.

If desired, the additional panels 216 can be associated with information leaflets in ways similar to those described above.

Figure 10:
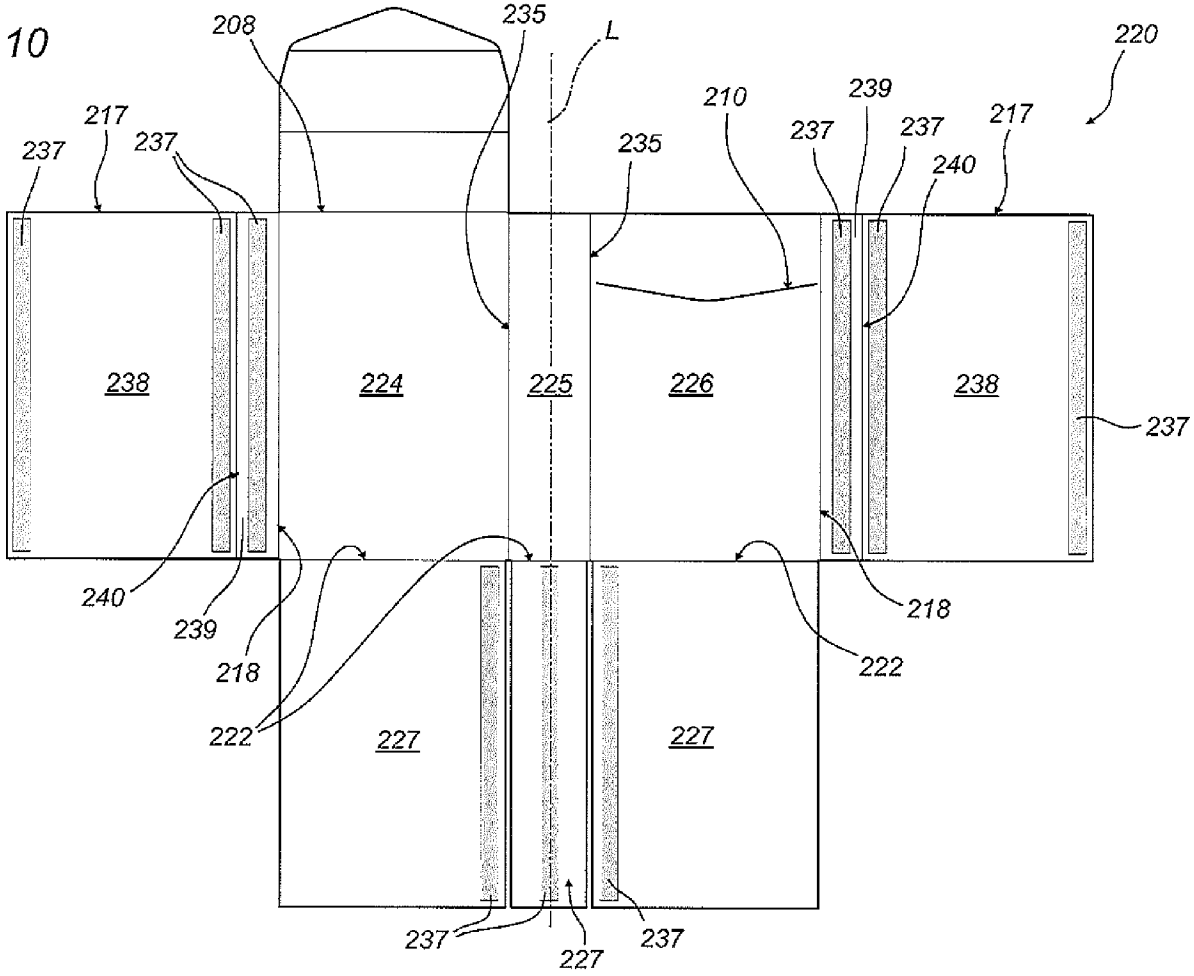
FIG. 10 is a plan view showing a blank used to make the hard cigarette packet of FIGS. 5 and 6, respectively.

As illustrated in FIG. 10, the outer wrapper 215 is obtained from a flat blank 220 having a substantially rectangular shape elongate according to a main axis of extension L.

After obtaining the outer wrapper 215, by folding the blank 220, the containers 209, the blanks of which are not described as of known type, are fixed to the outer wrapper 215 by fixing means 237. More specifically, strips of adhesive material 237 define the fixing means.

The blank 220 has a plurality of longitudinal lines of weakness 218, 235 and 240 and a plurality of transversal lines of weakness 222, which define a first, a second and a third panel 224, 225 and 226 and the first and second connection panels 238 and 239.

The third panel 226 comprises the notch 210.

The first, the second and the third panel 224, 225 and 226 and the first and second connection panels 238 and 239 are connected to each other by the respective longitudinal lines of weakness 218, 240 and 235.

The longitudinal lines of weakness 218, 240 and 235 are thereby defined as they are parallel to the main axis of extension L of the blank 220.

The lines of weakness 218 and 235 are designed to define, respectively, the second hinges 218 and the third hinge 235.

The lines of weakness 240 are designed to define the contiguous edge of the first and second connection panels 238 and 239.

Preferably, the first and second connection panels 238 and 239 each comprise strips of adhesive material 237.

The first, the second and the third panels 224, 225 and 226 have, respectively, a transversal line of weakness 222 from which extends a relative cover panel 227.

The additional panels 216 and the intermediate panel 234 of the outer wrapper 215 are obtained by folding the cover panels 227 along the transversal lines of weakness 222, in such a way as to superpose on the first panel 224, on the second panel 225 and on the third panel 226 a respective cover panel 227.

The cover panels 227 are fixed to the respective panels 224, 225 and 226 by the adhesive strips 237.

The first and the third panels 224 and 226 associated with the respective cover panel 227 define the additional panels 216.

The second panel 225 associated with the respective cover panel 227 defines the additional panel 234.

It should be noted that, in order to allow the rotation about the third hinges 235, the cover panels 227 have a transversal dimension slightly smaller than the transversal dimension of the respective panels 224, 225 and 226 to which they are applied.

The first panel 224 has a transversal line of weakness 208.

From the transversal line of weakness 208 extend, along the axis L and from the opposite side to the additional panel 216, a plurality of panels which, once folded, are designed to define the lid 207 of the packet 200.

After making the outer wrapper 215, by folding the blank 220, the containers 209, the blanks of which are not described as of known type, are fixed to the outer wrapper 215 by the strips of adhesive material 237.

More specifically, a larger side wall 211 of each container 209 is fixed to a first connection panel 238 and a smaller side wall 212 of each container 209 is fixed to a second connection panel 239.

The packet 1, 100, 200 described above solves the above-mentioned problems of the prior art and brings several advantages.

More specifically, the packet (1, 100, 200) is simple and easy to make as it can be produced by a known automatic packing machine with a few simple adjustments.

Thanks to the numerous advantages offered by the packet 1 described above, the form of the packet (1, 100, 200) might be reproduced to also make other types of hard containers for tobacco products such as, for example, a carton of cigarettes or a packet of cigars.

The invention claimed is:

1. A packet for tobacco products comprising:

at least two containers, each substantially having a shape of a parallelepiped and having two larger side walls, two smaller side walls, a bottom wall and a top wall, an outer wrapper comprising at least one connection panel and at least two additional panels;

the containers being connected to the outer wrapper at the at least one connection panel;

a lid being hinged along a first hinge to one of the at least two additional panels and rotatable between a closed position and an open position of the packet;

wherein the lid and the at least one connection panel are hinged to a same one of the at least two additional panels wherein, in the closed position, the lid keeps each of the at least two additional panels in face contact with one of the two larger side walls of a respective one of the at least two containers;

wherein, in the open position, each of the at least two additional panels is positioned in a position away from face contact with the one of the two larger side walls of the respective one of the at least two containers.

2. The packet according to claim 1, wherein the at least one connection panel is hinged to one of the at least two additional panels additional panel by second hinges.

3. The packet according to claim 1, wherein the at least one connection panel is interposed between two of the at least two additional panels; the containers being connected to the at least one connection panel by a respective smaller side wall and being in mutual contact at a respective larger side wall.

4. The packet according to claim 1, wherein in the closed condition of the packet the at least one connection panel defines a side of the packet.

5. The packet according to claim 1, wherein the at least one connection panel is subdivided into first and second connection panels; each container being connected to a respective first connection panel by a respective larger side wall and to a respective second connection panel by a respective smaller side wall.

6. The packet according to claim 5, wherein in the closed condition of the packet the second connection panels define a side of the packet.

7. The packet according to claim 5, wherein the first connection panels are hinged to each other along a third hinge.

8. The packet according to claim 5, wherein an intermediate panel is interposed between two additional panels and is hinged to the latter by third hinges; the second connection panels being hinged to a respective additional panel from the opposite side relative to the intermediate panel.

9. The packet according to claim 8, wherein in the closed condition of the packet the intermediate panel defines one of the sides of the packet.

10. The packet according to claim 1, and further comprising a respective hinge positioned between each of the at least two additional panels and the at least one connection panel;

wherein, in the open position of the packet, each of the at least two additional panels is positioned in the position away from face contact with the one of the two larger side walls of the respective one of the at least two containers by a rotation about the respective hinge.

* * * * *